United States Patent [19]

Suhara et al.

[11] Patent Number: 4,729,819

[45] Date of Patent: Mar. 8, 1988

[54] METHOD FOR RESTORING THE CURRENT EFFICIENCY

[75] Inventors: Manabu Suhara; Kohji Suzuki; Isamu Takeshita, all of Yokohama, Japan

[73] Assignee: Asahi Glass Company Ltd., Tokyo, Japan

[21] Appl. No.: 815,469

[22] Filed: Jan. 2, 1986

[30] Foreign Application Priority Data

Jan. 18, 1985 [JP] Japan ..... 60-5773

[51] Int. Cl.[4] ..... C25B 1/14

[52] U.S. Cl. ..... 204/98; 204/128

[58] Field of Search ..... 204/98, 128

[56] References Cited

U.S. PATENT DOCUMENTS

| | | | |
|---|---|---|---|
| 3,793,163 | 2/1974 | Dotson | 204/128 |
| 3,988,223 | 10/1976 | Hirozawa | 204/128 |
| 4,040,919 | 8/1977 | Eng | 204/98 |
| 4,115,218 | 9/1978 | Krumpelt | 204/128 |
| 4,202,743 | 5/1980 | Oda et al. | 204/98 |
| 4,204,921 | 5/1980 | Britton et al. | 204/98 |
| 4,236,980 | 12/1980 | Medic et al. | 204/98 |
| 4,360,412 | 11/1982 | Maloney | 204/98 |
| 4,366,037 | 12/1982 | Schulz et al. | 204/98 |
| 4,381,230 | 4/1983 | Burney, Jr. et al. | 204/98 |
| 4,434,041 | 2/1984 | Kelly et al. | 204/98 |

FOREIGN PATENT DOCUMENTS 0029751 3/1981 European Pat. Off. .

*Primary Examiner*—John F. Niebling
*Assistant Examiner*—Kathryn Rubino
*Attorney, Agent, or Firm*—Oblon, Fisher, Spivak, McClelland & Maier

[57] ABSTRACT

In the electrolysis of sodium chloride by means of a perfluoro cation exchange membrane for the production of sodium hydroxide having a concentration of from 32 to 40% by weight, a method for restoring the current efficiency, which comprises suspending the electrolysis when the current efficiency of the perfluoro cation exchange membrane has dropped to a predetermined level, and maintaining the catholyte concentration at a level of not higher than 30% by weight.

12 Claims, No Drawings

METHOD FOR RESTORING THE CURRENT EFFICIENCY

The present invention relates to the electrolysis of sodium chloride by means of a perfluoro cation exchange membrane. More particularly, it relates to a method for restoring the current efficiency of the perfluoro cation exchange membrane in the electrolysis.

In recent years, an ion exchange membrane method wherein a cation exchange membrane made of a fluorine resin is used as a diaphragm, has attracted attention as a method for producing sodium hydroxide and chlorine by the electrolysis of sodium chloride, since such an ion exchange membrane method is advantageous over the conventional mercury method or asbestos diaphragm method with a view to the prevention of pollution and the saving of energy, and it is thereby possible to produce sodium hydroxide of a high quality having an extremely low sodium chloride content. As the cation exchange membrane of a fluorine resin to be used for such an ion exchange membrane method, a carboxylic acid-type membrane is regarded as being advantageous over the sulfonic acid type membrane because it is thereby possible to produce sodium hydroxide in high concentration at high current efficiency. On the other hand, it has been pointed out that the carboxylic acid type fluorine resin membrane has a problem that it has a greater electric resistance than the sulfonic acid type fluorine resin membrane.

Heretofore, there have been various proposals for solving the above problems with respect to such a cation exchange membrane of a fluorine resin as a diaphragm for the electrolysis of sodium chloride. For instance, Japanese Unexamined Patent Publication No. 120492/1975 discloses a cation exchange membrane obtained by copolymerizing a carboxylic acid type monomer and a sulfonic acid type monomer, and a cation exchange membrane obtained by impregnating and polymerizing a carboxylic acid type monomer to an sulfonic acid type fluorine resin membrane, as a cation exchange membrane composed of a perfluorocarbon polymer containing both carboxylic acid groups and sulfonic acid groups. These cation exchange membranes are said to have both high current efficiency and high electric conductivity by virtue of the sulfonic acid groups having high electric conductivity in addition to the characteristics of carboxylic acid groups. Further, Japanese Unexamined Patent Publication No. 36589/1977 discloses a blend membrane of a carboxylic acid type perfluorocarbon polymer with a sulfonic acid type perfluorocarbon polymer, and a laminated membrane comprising a carboxylic acid type membrane and a sulfonic acid type membrane. In these cases, it is said that the difficulty with a sulfonic acid type membrane in the production of highly concentrated sodium hydroxide at high current efficiency can be solved by the lamination of the carboxylic acid type membrane or by the blending of the carboxylic acid type polymer.

Thus, a number of various proposals have been made for the purpose of improving the inadequate electrolytic performance of the sulfonic acid type membrane. For instance, a method is known in which the surface of a membrane made of a perfluorocarbon polymer having sulfonic acid groups is treated by reduction and/or oxidation treatment to chemically convert the sulfonic acid groups to carboxylic acid groups, so that a carboxylic acid thin layer is formed on the surface of the sulfonic acid type membrane (Japanese Unexamined Patent Publications Nos. 24175/1977, 24176/1977 and 24177/1977).

On the other hand, various methods have been proposed to restore the electrolytic performance in the electrolysis of sodium chloride by an ion exchange membrane method (Japanese Unexamined Patent Publications Nos. 3999/1978, 57199/1978, 29892/1979, 155996/1979, 22311/1980, 41858/1980 and 81745/1980). In these references, it is disclosed that a membrane with its current efficiency dropped due to the deposition of calcium and magnesium is treated with an acid and an alkali to remove calcium and magnesium and, if necessary, the membrane is converted to an ester type and heated; that the pH of the anode compartment is lowered, followed by electric conduction treatment; or that an organic solvent is used, followed by heat treatment. It is disclosed that by such regeneration treatments, the current efficiency can be restored.

In the electrolysis of sodium chloride by means of an ion exchange membrane wherein sodium hydroxide is obtained by using a membrane having perfluoro carboxylic acid groups on the side facing the cathode, it is common to conduct the electrolysis at a temperature of from 80° to 95° C. in order to maintain the electrolytic cell voltage at a low level. However, it may happen that the cell temperature drops to a level of less than 80° C. for a short or long period of time due to a change in the load or due to the requirement of the electrolytic system. Further, in some cases, it may happen that the sodium hydroxide concentration becomes abnormally high during the electrolysis. In such cases, the current efficiency will be lowered and may not completely be restored to the initial level even if the temperature after the low temperature electrolysis is returned to a level of about 90° C., or even if the sodium hydroxide concentration once exceeded 40% by weight is returned to the initial level of concentration. The higher the current density, the more likely such a reduction in the current efficiency is to occur. On the other hand, the reduction in the current efficiency is also depedent on the structure of the membrane such as the manner of reinforcement, the ion exchange capacity or the thickness of the membrane.

The actual causes for such a phenomenon are not clearly understood, but the following comments may be made. Namely, in order to obtain highly concentrated sodium hydroxide in high efficiency, it is required that the fixed ion concentration on the cathode side of the membrane is high. When the fixed ion concentration is high, water molecules around the fixed ions are less, whereby the movement of Na counter ions is likely to be restricted by the fixed ions, and the activation energy for the movement of the Na ions in the membrane tends to be high. Accordingly, the movement of the Na ions is substantially lowered when the temperature drops. If the electrolysis is conducted under such a condition, the structure of water-containing state around the fixed ions will be changed, and will not be restored to the initial structure even when the temperature will be raised again to the initial level, and thus the current efficiency will not be restored.

Such a phenomenon is undesirable because it brings about an increase in the consumption of the electrolytic power. It has been proposed to prevent such a phenomenon by lowering the concentration of sodium hydroxide to be obtained or by lowering the current density when the cell temperature lowers.

It is an object of the present invention to provide a new method for restoring the current efficiency of the membrane with its efficiency dropped, without relying on such conventional methods. Especially, it is intended to solve the above-mentioned drawbacks without disassembling the electrolytic cell.

The present invention has been accomplished to solve the above problems and provides a method for restoring the current efficiency in the electrolysis in the sodium chloride by means of a perfluoro cation exchange membrane for the production of sodium hydroxide having a concentration of from 32 to 40% by weight, which comprises suspending the electrolysis when the current efficiency of the perfluoro cation exchange membrane has dropped to a predetermined level, and maintaining the catholyte concentration at a level of not higher than 30% by weight.

Now, the present invention will be described in detail with reference to the preferred embodiments.

In the specification, the perfluoro cation exchange membrane is meant for a membrane with its entirety or at least the surface facing the cathode being made of a perfluoro carboxylic acid polymer. The membrane having perfluoro carboxylic acid groups on its cathode side is preferred since it is thereby possible to obtain highly concentrated sodium hydroxide at high current efficiency. It is known to use a membrane having an asymmetric structure wherein a perfluoro carboxylic acid polymer having a larger ion exchange capacity than the cathode side polymer or a perfluoro sulfonic acid polymer having a larger water content than the cathode side polymer is used on the anode side, and reinforced with e.g. woven fabric, non-woven fabric or microfibrils made of a corrosion resistant fluorine resin, in order to obtain sodium hydroxide at high current efficiency with a low resistance and to impart practical membrane strength thereto.

In the present invention, the carboxylic acid type perfluorocarbon polymer and the sulfonic acid type perfluorocarbon polymer constituting the above-mentioned respective layers, are not particularly restricted to those known or well-known in the art, and any types may be employed so long as they satisfy the above-mentioned specific requirements. According to a preferred embodiment, it is particularly preferred to employ a polymer having the following structures (i) and (ii):

$$\left(CF_2-CFX\right), \quad \text{(i)}$$

$$\left(CF_2-\underset{\underset{Y}{|}}{CX}\right) \quad \text{(ii)}$$

where X is F or $-CF_3$, preferably F, and Y is selected from the following groups:

$$\left(CF_2\right)_x-A,\ -O\left(CF_2\right)_x-A,\ \left(O-CF_2-\underset{\underset{Z}{|}}{CF}\right)_y A,$$

$$-CF_2-O\left(CF_2\right)_x-A,\ -O\left(CF_2-\underset{\underset{R_f}{|}}{CF}-O\right)_y\left(CF_2\right)_x-A,$$

$$\left(O-CF_2-\underset{\underset{Z}{|}}{CF}\right)_x\left(O-CF_2-\underset{\underset{R_f}{|}}{CF}\right)_y A,$$

-continued $$-CF_2\left(O-CF_2-\underset{\underset{Z}{|}}{CF}\right)_x\left(O-CF_2-\underset{\underset{R_f}{|}}{CF}\right)_y A.$$

$$-O-CF_2\left(\underset{\underset{Z}{|}}{CF}-O-CF_2\right)_x\left(CF_2\right)_y\left(CF_2-O-\underset{\underset{R_f}{|}}{CF}\right)_z A$$

wherein each of x, y and z is from 0 to 10, and each of Z and $R_f$ is selected from the group consisting of —F or a perfluoroalkyl group having from 1 to 10 carbon atoms. Further, A is $-SO_3M$ or —COOM, or a group which can be converted to such groups by hydrolysis, such as $-SO_3F$, —CN, —COF or —COOR, where M is a hydrogen atom or an alkali metal, and R is an alkyl group having from 1 to 10 carbon atoms.

The membrane of the present invention has a total thickness of from 60 to 350 μm, preferably from 100 to 300 μm, and if required, it may be reinforced by a woven fabric such as a cloth or a net, or a non-woven fabric, preferably made of e.g. polytetra- fluoroethylene, or by a metallic mesh or perforated sheet as disclosed in U.S. Pat. Nos. 4,021,327 and 4,437,951. Otherwise, the membrane of the present invention may be reinforced by blending fibrillated fibers of polytetrafluoroethylene as disclosed in e.g. Japanese Unexamined Patent Publications Nos. 149881/1978, 1283/1979, 107479/1979 and 157777/1979, or by blending fibrillated fibers of polytetrafluoroethylene modified by the copolymerization with a small amount of an acid type functional group-containing monomer, as disclosed in e.g. Japanese Unexamined Patent Publication No. 79110/1981. Further, it is possible to employ reinforcement by blending other low molecular polymers. Further, the membrane of the present invention may be modified by roughening its surface, or by forming a porous thin layer composed of metal oxide particles on its surface as disclosed in European Patent Publication No. 29751. When the above-mentioned various reinforcing means are to be employed in the present invention, it is preferred to apply them to the carboxylic acid film main layer.

In the present invention, the film-forming for each layer or the mixing for the preparation of the blend composite film layer may be conducted by various conventional methods. For instance, the mixing may be conducted in a wet system by using an aqueous dispersion, an organic solution or an organic dispersion of an ion exchange group-containing perfluorocarbon polymer. The film forming can be conducted by a casting method by using such an organic solution or organic dispersion. Of course, the dry blending system may be employed, or the film formation may be conducted by a heat melting molding method. When a film for each layer is formed by the heat melting molding method, the ion exchange groups of the starting polymer should take a suitable form not to lead to decomposition thereof. For instance, in the case of carboxylic acid groups, they should preferably take a form of an acid or an ester, and in the case of sulfonic acid groups, they should preferably take a form of $-SO_3F$. Alternatively, the starting material polymer may firstly be pelletized by heat melting molding, and then molded by extrusion or press molding into a film.

The multi-layer type membrane of the present invention is usually prepared in such a manner that the carboxylic acid film main layer, the sulfonic acid film surface layer, the carboxylic acid film surface layer and, if required, the composite film layer or the carboxylic acid film intermediate layer, are respectively separately prepared in the form of predetermined films, and they are laminated. As the method for the lamination of the layers, there may be mentioned flat plate pressing or roll pressing. The temperature for pressing is usually from 60° to 280° C., and the pressure is from 0.1 to 100 kg/cm$^2$ by the flat plate pressing and from 0.1 to 100 kg/cm by roll pressing.

The multi-layer type membrane of the present invention may be used in a wide range in various electrolyses. In such a case, any type of electrodes may be used. For instance, there may be employed perforated electrodes such as foraminous plates, nets, punched metals, or expanded metals. As the perforated electrode, there may be mentioned an expanded metal having openings with a long opening diameter of from 1.0 to 10 mm and a short opening diameter of from 0.5 to 10 mm, the wire diameter of from 0.1 to 1.3 mm and a opening rate of from 30 to 90%. Further, a plurality of plate-like electrodes may also be used. It is particularly preferred to use a plurality of electrodes having different opening rates, wherein electrodes having smaller opening rates are disposed close to the membrane.

The anode may usually be made of a platinum group metal or its electro-conductive oxides or electro-conductive reduced oxides. On the other hand, the cathode may be made of a platinum group metal, its electro-conductive oxides or an iron group metal. As the platinum group metal, there may be mentioned platinum, rhodium, ruthenium, palladium and iridium. As the iron group metal, there may be mentioned iron, cobalt, nickel, Raney nickel, stabilized Raney nickel, stainless steel, an alkali etching stainless steel (U.S. Pat. No. 4,255,247), Raney nickel-plated cathode (U.S. Pat. Nos. 4,170,536 and 4,116,804) and Rodan nickel-plated cathode (U.S. Pat. Nos. 4,190,514 and 4,190,516).

In the case where perforated electrodes are used, the electrodes may be made of the above-mentioned materials for the anode or cathode. However, when a platinum group metal or its electro-conductive oxides are used, it is preferred to coat these substances on the surface of an expanded metal made of a valve metal such as titanium or tantalum.

When an electrode is to be installed, it may be disposed in contact with the multi-layer type membrane of the present invention, or may be disposed with a space from the membrane. The electrode should be pressed gently rather than firmly against the membrane surface. For instance, the electrode is preferably gently pressed under pressure of from 0 to 2.0 kg/cm$^2$ against the ion exchange membrane surface.

The electrolytic cell in which the multi-layer type membrane of the present invention is used, may be a monopolar type or bipolar type. With respect to the material constituting the electrolytic cell, for instance, in the case of the anode compartment for the electrolysis of an aqueous alkali metal chloride solution, a material resistant to an aqueous alkali metal chloride solution and chlorine, such as a valve metal like titanium, may be used, and in the case of the cathode compartment, iron, stainless steel or nickel resistant to an alkali hydroxide and hydrogen, may be used.

The electrolysis of an aqueous alkali metal chloride solution by using the multi-layer type membrane of the present invention, may be conducted under conventional conditions. For instance, the electrolysis is conducted preferably at a temperature of from 80° to 120° C. at a current density of from 10 to 100 A/dm$^2$ while supplying preferably a 2.5–5.0N alkali metal chloride aqueous solution to the anode compartment and water or diluted alkali metal hydroxide to the cathode compartment. In such a case, it is preferred to minimize the presence of heavy metal ions such as calcium or magnesium in the aqueous alkali metal chloride solution, since such heavy metal ions bring about a deterioration of the ion exchange membrane. Further, in order to prevent as far as possible the generation of oxygen at the anode, an acid such as hydrochloric acid may be added to the aqueous alkali metal chloride solution.

The present invention is directed to the treatment of a membrane which has been used for the electrolysis at a low temperature and the current efficiency of which can not be restored even when the electrolytic temperature is raised again to a level of from 80° to 95° C. or a membrane which has been subjected to an abnormally high sodium hydroxide concentration (e.g. a concentration exceeding 40% by weight) and the current efficiency of which can not be restored even when the sodium hydroxide concentration is returned to the initial level. As a result of extensive researches for restoring the performance of such a membrane, it has been discovered that the current efficiency can be restored by suspending the electrolysis and maintaining the catholyte concentration at a low level, before resuming the electrolysis.

Even if the catholyte concentration is lowered while continuing the electrolysis, no restoration of the current efficiency is observed. On the other hand, even if the electrolysis is suspended, no substantial effects for restoration can be obtained if the catholyte concentration is high. Thus, the catholyte concentration should be lowered to a level of not higher than 30% by weight. It is particularly preferred to lower the concentration to a level of not higher than 26% by weight, whereby remarkable effects can be obtained.

The period for maintaining the catholyte concentration at a low level under suspension of the electrolysis should be at least 1 hour and usually over night with a view to obtainining adequate effects. However, the period may be longer.

The temperature during the period of maintaining the catholyte concentration at a low level under suspension of the electrolysis is preferably from room temperature to 80° C. Certain effects are obtainable even at a temperature exceeding 80° C. However, such a high temperature is undesirable since the energy costs and the installation costs will be substantial to maintain such a high temperature. Further, when the temperature is high, the deterioration of the current efficiency due to swelling is likely to result. Accordingly, it is preferred to maintain the sodium hydroxide concentration at a level of from 20 to 30% by weight when the temperature is relatively high, and to maintain the sodium hydroxide concentration at a level of 0 to 20% by weight when the temperature is low at a level of from room temperature to 40° C., whereby the current efficiency can be restored without leading to the deterioration of the current efficiency due to swelling.

For the operation of the above method, it is also preferred to simultaneously lower the sodium chloride concentration in the anolyte. This is intended to minimize the diffusion of sodium chloride into the cathode compartment and thereby to minimize the deterioration of the cathode by the diffusion of sodium chloride.

The mechanism for the restoration of the current efficiency by maintaining the catholyte concentration at a low level under suspension of the electrolysis according to the present invention is not clearly understood. However, it is believed that the cathode side of the membrane will be swelled by the application of the method of the present invention and the rearrangement of the polymer chains may readily be conducted by the removal of the external electric field, whereby the structure returns to the initial state where Na is readily movable.

Now, the present invention will be described in detail with reference to Examples. However, it should be understood that the present invention is by no means restricted to these specific Examples.

EXAMPLE 1

Tetrafluoroethylene and $CF_2{=}CFO(CF_2)_3COOCH_3$ were catalytically polymerized under different pressures and temperatures to obtain copolymers having an ion exchange capacity of 1.85 meq/g and 1.20 meq/g, respectively. The former is designated as copolymer A, and the latter is designated as copolymer B. Copolymer A was extrusion-molded to obtain films having a thickness of 50 μm and 150 μm, respectively. The films are designated as A-1 and A-2, respectively. Copolymer B was extrusion-molded to obtain a film having a thickness of 30 μm. The film was designated as B-1. As a reinforcing cloth, a woven fabric made of PTFF threads was employed. The woven fabric was made of warp yarn with 20 mesh with two threads of 75 denier and weft yarn with 37 mesh with one thread of 150 denier. Firstly, the woven fabric, A-2 and B-2 were laminated in this order at 200° C. by heat roll pressing, and then A-1 was placed on the woven fabric of the laminate to obtain a composite membrane of copolymer A 50 μm/woven fabric/copolymer A 150 μm/copolymer B 30 μm.

On the other hand, a mixture comprising 10 parts by weight of zirconium oxide powder having a particle size of 5 μm, 0.4 part by weight of methyl cellulose (viscosity of 2% aqueous solution: 1500 centipoise), 19 parts by weight of water, 2 parts by weight of cyclohexanol and 1 part by weight of cyclohexanone was kneaded to obtain a paste. The paste was screen-printed on the copolymer A 50 μm side of the ion exchange membrane prepared by the lamination as mentioned above, by using a Tetron screen of 200 mesh having a thickness of 75 μm, a printing plate therebeneath provided with a screen mask having a thickness of 30 μm and a polyurethane squeegee. The deposited layer on the membrane surface was dried in air.

Likewise, β-silicon carbide particles having an average particle size of 0.3 μm were deposited in the same manner on the other side of the membrane having a porous layer, thus obtained. Then, the particle layers on both sides of the membrane were pressed against the ion exchanqe membrane surfaces at a temperature of 140° C. under a pressure of 30 kg/cm$^2$, to obtain an ion exchange membrane having 1.0 mg/cm$^2$ of zirconium oxide particles and 0.7 mg/cm$^2$ of silicon carbide particles on the anode side and the cathode side of the membrane, respectively.

The membrane was subjected to hydrolysis in a 25% sodium hydroxide aqueous solution at 65° C. for 16 hours to obtain an ion exchange membrane of sodium type.

To the A-1 laver side of the membrane thus obtained, an anode prepared by coating a solid solution of ruthenium oxide, iridium oxide and titanium oxide on a titanium punched metal (short opening diameter: 2 mm, long opening diameter: 5 mm) and having a low chlorine over voltage, was pressed to be in contact with the membrane. Likewise, to the B-1 layer side of the membrane, a cathode prepared by electro depositing a ruthenium-containing Raney nickel (ruthenium: 5%, nickel: 50%, aluminum: 45%) on a SUS 304 punched metal (short opening diameter 2 mm, long opening diameter: 5 mm) and having a low hydrogen overvoltage, was pressed to be in contact with the membrane. Then, electrolysis was conducted at 90° C. at a current density of 30 A/dm$^2$, while maintaining the sodium chloride solution in the anode compartment at a level of 200 g/liter and the sodium hvdroxide concentration in the cathode compartment at a level of 35% by weight.

The electrolysis was conducted for 7 days, whereupon the current efficiency was 95.8%, and the cell voltage was 2.92 V. Thereafter, the electrolysis was conducted for 1 day with the cell temperature lowered to 70° C., while maintaining the current density at a level of 30 A/dm$^2$. Then, the cell temperature was raised again to 90° C., and 1 day later, the current efficiency was 92.5%, and the current efficiency for 2–4 days was constant at a level of 93.0% and the cell voltage was 2.92 V.

The operation of the electrolytic cell with its current efficiency dropped, was terminated, and the cell temperature was lowered to 70° C. Then, the catholyte was replaced by 25% sodium hydroxide, and left to stand still for 48 hours while supplying an aqueous sodium chloride solution to the anode compartment. Thereafter, the electrolysis was again conducted, and 1 day later, the current efficiency was 95.4% and the cell voltage was 2.92 V under the conditions of 30 A/dm$^2$, 90° C., 200 g/liter NaCl and 35% NaOH. The current efficiecy for 2–10 days was restored substantially to the initial value of 95.7%.

EXAMPLE 2

Tetrafluoroethylene and $CF_2{=}CFO(CF_2)_3COOCH_3$ were catalytically polymerized to obtain copolymers having an ion exchange capacity of 1.44 meq/g and 1.20 meq/g, respectively. The former is designated as copolymer A, and the latter is designated as copolymer B. On the other hand, tetrafluoroethylene and $CF_2{=}CFOCF_2CF(CF_3)O(CF_2)_2SO_2F$ are also catalytically polymerized to obtain a copolymer having an ion exchange capacity of 1.1 meq/g. This is designated as copolymer C. Copolymers A and C were blended in a weight ratio of 1:1 and kneaded by heat rolls to obtain blend D. By extrusion molding, film E having a thickness of 160 μm was prepared from copolymer A, film F having a thickness of 20 μm was prepared from copolymer B, film G having a thickness of 20 μm was prepared from copolymer C, and film H having a thickness of 15 μm was prepared from blend D. Then, these films were placed one after another in the order of G, H, E and F and laminated at 200° C. by heat rolls. In the same manner as in Example 1, a zirconium oxide particles were deposited on the G layer side of the laminated membrane and silicon carbide was deposited on the F layer side of the laminated membrane. The membrane was then hydrolyzed and subjected to electrolytic tests in the same manner as in Example 1. Namely, the electrolysis was conducted at a current density of 30 A/dm$^2$ at 90° C. while maintaining the sodium chloride concentration in the anode compartment at a level of 200 g/liter and the sodium hydroxide concentration in the cathode compartment at a level of 36%. Seven days later, the current efficiency was 96.0%, and the cell voltage was 3.02 V. Thereafter, the electrolysis was conducted for 3 days with the cell temperature lowered to a level of 65° C. while maintaining the current density at 30 A/dm$^2$. Then, the cell temperature was raised again to 90° C., and 1 day later, the current efficiency was 93.1%, and 4 days later, the current efficiency was 93.5% and the cell voltage was 3.02 V.

The operation of the electrolytic cell with the current efficiency lowered, was terminated, and the cell temperature was lowered to 30° C. Then, the catholyte was replaced by water, and the cell was left to stand still for 10 hours while supplying an aqueous sodium chloride solution to the anode compartment. Thereafter, the electrolysis was conducted again. Two days later, the current efficiency was restored substantially to the initial value of 96.0% under the conditions of 30 A/dm$^2$, 90° C., 200 g/liter NaCl and 36% NaOH. The electrolysis was continued for further 30 days, whereby the current efficiency was maintained at a level of 96%.

EXAMPLE 3

A membrane was prepared and hydrolyzed in the same manner as in Example 1, and the electrolysis was conducted under the same condition for 10 days, whereupon the current efficiency was 95.8% and the cell voltage was 2.92 V. Thereafter, the electrolysis was conducted for 3 days with the sodium hydroxide concentration raised to 42% by weight while maintaining the current efficiency at 30 A/dm$^2$ and the cell temperature at 90° C. Then, the sodium hydroxide concentration was lowered again to 35% by weight, whereupon the current efficiency was 93.0% and the cell voltage was 2.93 V.

The operation of the electrolytic cell with the current efficiency lowered, was terminated, and the cell temperature was lowered to 40° C. Then, catholyte and anolyte were discharged, and deionized water was filled afresh to the cathode and anode compartments and the cell was maintained at 25° C. for 16 hours.

Then, water was discharged from both compartments. An aqueous solution containing 300 g/liter of sodium chloride was filled in the anode compartment, and an aqueous solution containing 30% by weight of sodium hydroxide was filled in the cathode compartment. Then, the electrolysis was conducted again. Two days later, the current efficiency was restored to the initial value of 95.8% under the conditions of 30 A/dm$^2$, 90° C., 200 g/liter NaCl and 35% NaOH. The electrolysis was continued for further 20 days, whereby the current efficiency was maintained at a level of 95.8%.

We claim:

1. In the electrolysis of sodium chloride by means of a perfluoro cation exchange membrane having carboxylic acid groups as ion exchange groups on the side facing the cathode, for the production of sodium hydroxide having a concentration of from 32 to 40% by weight, a method for restoring the current efficiency of the membrane which has dropped due to a decrease of the electrolytic temperature to a level of at most 80° C. or an increase of the sodium hydroxide concentration to a level of at least 40% during the electrolysis, which comprises suspending the electrolysis when the current efficiency of the perfluoro cation exchange membrane has dropped to a predetermined level, and maintaining the catholyte concentration at a level of not higher than 30% by weight.

2. The method for restoring the current efficiency according to claim 1, wherein the perfluoro cation exchange membrane is made essentially of a perfluorocarbon polymer having carboxylic acid groups as ion exchange groups.

3. The method for restoring the current efficiency according to claim 2, wherein the perfluoro cation exchange membrane is an asymmetric membrane of the perfluorocarbon polymer with its ion exchange capacity on the side facing the anode being larger than its ion exchange capacity on the side facing the cathode.

4. The method for restoring the current efficiency according to claim 1, wherein the perfluoro cation exchange membrane is an asymmetric membrane with its side facing the cathode being made of a carboxylic acid type perfluorocarbon polymer and with its side facing the anode being made of a sulfonic acid type perfluorocarbon polymer.

5. The method for restoring the current efficiency according to claim 1, wherein the perfluoro cation membrane is reinforced with fibrils, woven fabric or non-woven fabric.

6. The method for restoring the current efficiency according to claim 5, wherein the fibrils are made of a fibrilated fiber of polytetrafluoroethylene or a fibrilated fiber of polytetrafluoroethylene modified by the copolymerization with a small amount of a monomer containing an acid-type functional group.

7. The method for restoring the current efficiency according to claim 5, wherein the woven fabric or non-woven fabric is made of polytetrafluoroethylene.

8. The method for restoring the current efficiency according to claim 1, wherein the perfluoro cation exchange membrane has its surface roughened or formed with an electrocatalytically inactive porous layer composed essentially of metal oxide particles.

9. The method for restoring the current efficiency according to claim 1, wherein the electrolysis is suspended for a period of at least 1 hour.

10. The method for restoring the current efficiency according to claim 1, wherein the catholyte concentration is maintained at a level of not higher than 26% by weight during the suspension of the electrolysis.

11. The method for restoring the current efficiency according to claim 1, wherein the catholyte is maintained at a temperature of from room temperature to 80° C. during the suspension of the electrolysis.

12. The method for restoring the current efficiency according to claim 1, wherein the catholyte concentration is maintained at a level of from 20 to 30% by weight for the catholyte temperature of from 40° to 80° C. and from 0 to 20% by weight for the catholyte temperature of from room temperature to 40° C. during the suspension of the electrolysis.

* * * * *